US005507246A

United States Patent [19]

Rand, Jr.

[11] Patent Number: 5,507,246

[45] Date of Patent: Apr. 16, 1996

[54] VISIBLE SIGNALING SPORTS WHISTLE

[76] Inventor: David Rand, Jr., 1949 SW. Palm City Rd., Stuart, Fla. 34994

[21] Appl. No.: 334,967

[22] Filed: Nov. 7, 1994

[51] Int. Cl.[6] ..... G10K 5/00

[52] U.S. Cl. ..... 116/137 R; 446/205

[58] Field of Search ..... 116/2, 4, 39, 137 R; 446/200, 202, 204, 205, 216

[56] References Cited

U.S. PATENT DOCUMENTS

| | | | |
|---|---|---|---|
| 2,730,920 | 1/1956 | Bacon | 446/205 X |
| 3,763,591 | 10/1973 | Fontana | 446/202 |
| 4,291,704 | 9/1981 | Petty et al. | 446/202 X |

FOREIGN PATENT DOCUMENTS

| | | | |
|---|---|---|---|
| 159791 | 4/1905 | Germany | 446/204 |
| 799799 | 8/1958 | United Kingdom | 446/200 |

*Primary Examiner*—William A. Cuchlinski, Jr.
*Assistant Examiner*—Willie Morris Worth
*Attorney, Agent, or Firm*—Carroll F. Palmer

[57] ABSTRACT

A mouth blown sports whistle includes a mouthpiece that communicates with a sound chamber and emits an audio signal when pressurized air is blown into the mouthpiece and a second chamber that communicates via a passageway with the sound chamber. A visual member is housed in the second chamber in a retracted position so as to be capable of extending through an opening therein to an extended position when pressurized air enters the second chamber from said sound chamber to thereby render a visual signal of the blowing of the whistle. The whistle may further include a check valve associated with the second chamber to temporally hold the visual member in its extended position after the extension thereof and also a release valve associated with the second chamber to permit the visual member to return to its retracted position to ready the whistle for another combined audio and visual signalling.

4 Claims, 1 Drawing Sheet

VISIBLE SIGNALING SPORTS WHISTLE

BACKGROUND OF THE INVENTION

1. Field of the Invention

This application relates to sports whistles such as used by referees at sporting events to signal occurrence of a rules infraction or other events. More particularly, it concerns improvements in such sports whistles so that they provide a visual signal in addition to the conventional audio signal.

2. Description of the Prior Art

In many contact type sporting events, e.g., football, soccer, ice-hockey, basketball, etc., a whistle is carried by the referees to be blown as a signal to notify the players and spectators of the occurrence of an infraction of the rules of the game, to call time out or other event. Changes in rules, spectator attendance, media coverage and technology have rendered these historic referee sport whistles in need of improvement so that they can confront these changes, but without need to introduce a totally new type of signalling device for use by referees. Thus, in order to keep pace with instant replay technology, increased attendance of sporting events by the hearing impaired, etc., there exists a need for the conventional referee whistle to provide a visual signal in addition to its typical audio signal.

By way of example, the National Hockey League permits the use of instant replay technology to assist referees to call certain plays correctly. One permissible instance is for the determination as to whether a goal has been scored or not. If a referee loses sight of the puck, he is instructed to blow his whistle thereby stopping any further play. If the puck is in a goalie's crease, and if, for example, four players also are in the crease scrambling for possession of the puck, often times the referee has to blow his whistle because the sheer number of bodies has blocked the referee's view of the puck. However, on numerous occasions, the puck has managed to elude the sight of the referee and find its way across the goal line and into the net. The question then arises as to whether the goal was scored before or after the referee had blown his whistle. The crowd noise at NHL games can drown out any sound reproduction that might otherwise be audible on an instant replay. So, when checking the video of a play, the official who is in charge of the instant reply, may still be unable to determine if the puck crossed the goal line either before or after the on-ice referee had "sounded" his whistle. Hence, a need exists so that a replay official can "see" that the on-ice referee had blown his whistle after (or before) the puck had crossed the goal line thereby allowing the goal to count (or not allowing it to count if the whistle had been blown before the goal was made). Ear-splitting crowd noise would no longer be a barrier to being able to correctly call the play.

It has previously been known in toy and party items to combine a whistle designed to be blown by a person's mouth with an extension element that visibly extends from the whistle as long as it is blown, e.g., see U.S. Pat. Nos. 530,909 and 532,642. However, as soon as such whistles stop blowing, the extension element in such whistle toys retracts so they do not meet the needs of a visual indicating sports whistle comparable to those provided by this invention.

OBJECTS

A principal object of the invention is the provision of improved sports whistles of the type used by referees at sporting events.

A further object is to improve such whistles so they can keep up with changing rules, technology and other conditions associated with the conduct of modern contact sports while maintaining the historic referee whistle as an accepted signalling device.

Another object is to add a visual indication feature to such whistles.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a modification to the standard referee sports whistles whereby when air is blown into them, a periscope-like member pops up and out vertically through an opening on the top of the whistle for the purpose of visibly showing when the whistle has been blown. This periscope-like member pops up at the same time that the sound of the whistle is heard. Thus, it will now be possible for the deaf, hard of hearing and hearing impaired, when either as participants in sporting events or as spectators, to know when a referee has blown his whistle. It will also be possible to know the precise instant that a referee's whistle has been sounded when examining instant replays at sporting events when, for example, it is important to know, particularly during video replay, whether a critical game event occurred either before or after the referee had blown his whistle stopping the play. The invention also serves as an antidote generally to intense crowd noise which may totally drown out the sound of a referee's whistle.

The sound of the whistle as well as the appearance of the pop out member are both activated by the human breath that is blow through the new form of sports whistle.

In preferred embodiments, the pop out member is brightly colored, e.g., is fluorsecent, so that even a hard of hearing spectator, sitting near the back of a grandstand at a sports event can see when the referee has blown his whistle to signal some event requiring referee intervention.

In addition to contact sports, it is anticipated that the new whistles of the invention can be used like a starting gun at contests such as swimming meets and track events so as to signal the start of the event for deaf participants.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 3:
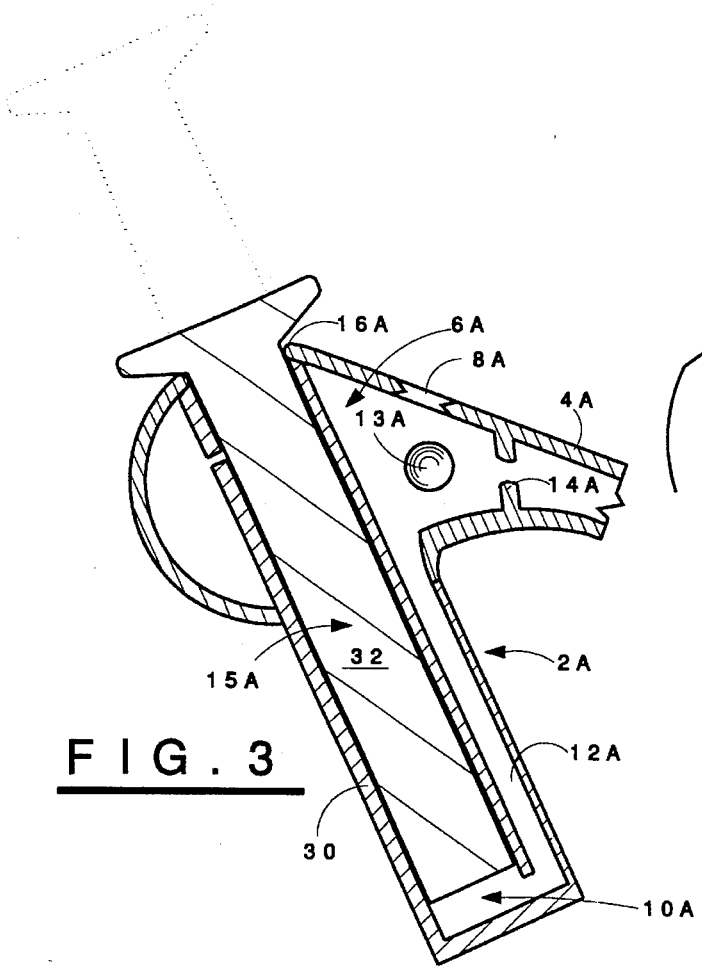
FIG. 3 is a lateral sectional view of another embodiment of a sports whistle of the invention.

For a detailed description of the invention, reference is made to the drawings in which generic parts of the illustrated matter are indicated by arrowhead lines associated with the designation numerals and specific parts are indicated with plain lines associated with the numerals.

The new mouth blown sports whistle 2 of the invention comprises a mouthpiece 4, a sound chamber 6 that communicates with mouth piece 4 and emits an audio signal though the opening 8 when pressurized air is blown into the mouthpiece and a second chamber 10 that communicates via passageway 12 with sound chamber 6.

The chamber 6 contains a sound modification ball 13 and there is a barrier 14 sized to retain the ball 13 within the chamber 6 defining chamber's 6 connection with the mouthpiece 4.

Figure 1:
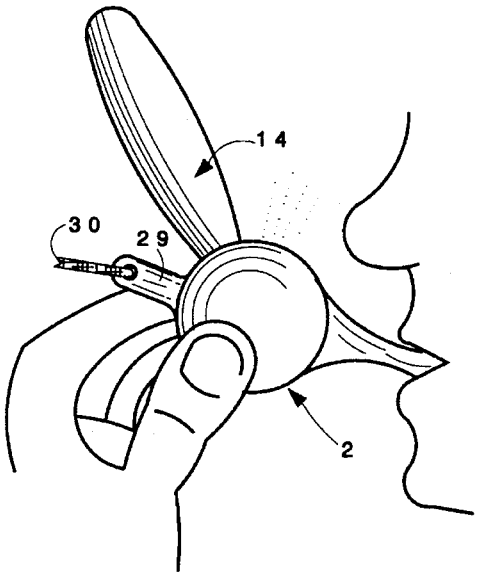
FIG. 1 is diagrammatic representation of a person blowing a improved sports whistle of the invention.
Figure 2:
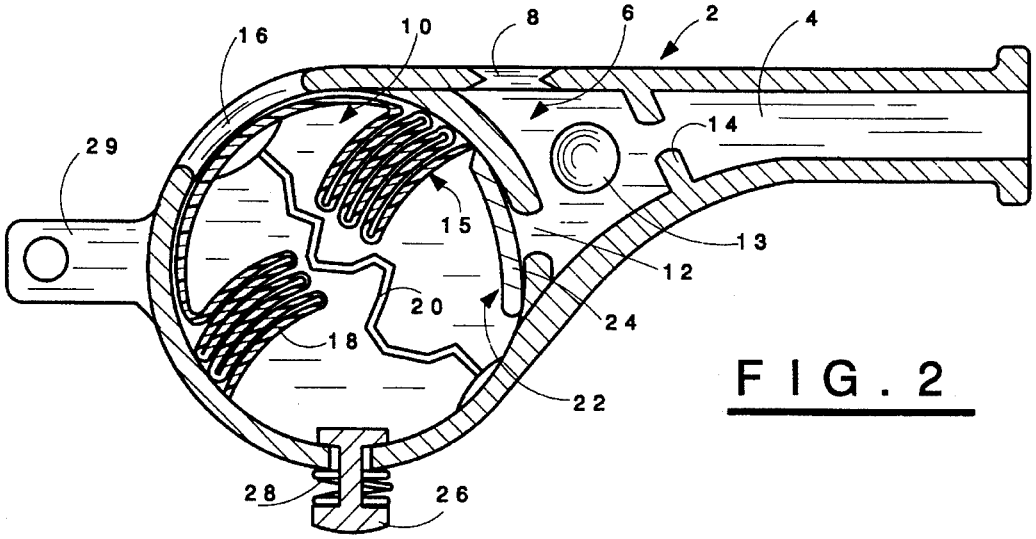
FIG. 2 is a lateral sectional view of one embodiment of a sports whistle of the invention.

A visual member 15 is housed in second chamber 10 in a retracted position (see FIG. 2) so as to be capable of extending through opening 16 to an extended position (see FIG. 1) when pressurized air enters second chamber 10 from sound chamber 6. Advantageously, member 15 comprises a balloon 18 made of flexible plastic or elastomeric material and a elastic cord 20 which constitutes means to cause balloon 18 to return to the retracted position upon release of pressurized air holding it in the extended position during signalling the occurrence of an event by the blowing of the whistle 2.

Pressure retention means 22 to temporally hold the visual member 15 in its extended position comprises a flap type check valve 24 associated with the passageway 12.

Pressure release means 26 associated with second chamber 10 to permit visual member 15 to return to its retracted position to ready it for another signalling operation comprises a release valve 26 biased by spring 28 into its closed position.

The whistle 2 includes a lug 29 by which a lanyard 30 may be fastened to it.

Another embodiment of a mouth blown sports whistle 2A of the invention comprises a mouthpiece 4A, a sound chamber 6A that communicates with mouthpiece 4A to emit an audio signal through the opening 8A when pressurized air is blown into mouthpiece 4A.

The chamber 6A contains a sound modification ball 13A and there is a barrier 14A, sized to retain the ball 13A within the chamber 6A, defining its connection with the mouthpiece 4A.

A second chamber 10A communicates with sound chamber 6A via passageway 12A and visual member 15A is housed therein in a retracted position so as to be capable of extending through opening 16A to an extended position, as shown in phantom line, when pressurized air enters chamber 10A from chamber 6A.

The second chamber 10A comprises an elongated cylinder portion 30 and visual member 15A is a piston 32 slidably carried in said cylinder portion. The cylinder portion 30 and piston 32 are structured so that friction between the two is not sufficient to prevent full extension of the piston 32 upon the blowing of the whistle 2A, but is sufficient to act as retention means associated with second chamber 10A to temporally hold visual member 15A in its extended position after extension thereof, while not so great as to prevent the piston 32 from being easily pushed back to its retracted position for restoration of the whistle **2*a*** into its signalling mode.

The embodiments of the invention in which an exclusive property or privilege is claimed are defined as follows:

1. A mouth blown sports whistle comprising:

a mouthpiece, a sound chamber that communicates with said mouth piece and emits an audio signal though an opening therein when pressurized air is blown into said mouthpiece, and a second chamber that communicates via a passageway with said sound chamber, a visual member housed in said second chamber in a retracted position so as to be capable of extending through an opening in said second chamber to an extended position when pressurized air enters said second chamber from said sound chamber, pressure retention means associated with said second chamber to temporally hold said visual member in said extended position after said extension thereof, and pressure release means associated with said second chamber to permit said visual member return to said retracted position after said extension thereof.

2. The sports whistle of claim 1 wherein said visual member comprises a balloon and means to assist said balloon to return to said retracted position upon release of pressurized air holding it in said extended position.

3. The sports whistle of claim 1 wherein said pressure retention means is a check valve associated with said passageway.

4. The sports whistle of claim 1 wherein said pressure release means is a spring biased release valve.

* * * * *